United States Patent [19]

Arai et al.

[11] Patent Number: 4,626,877

[45] Date of Patent: Dec. 2, 1986

[54] HEAT-SENSITIVE RECORDING MATERIAL

[75] Inventor: Naoto Arai, Ikeda, Tohru Yamamoto, Anan,both of Japan

[73] Assignee: Kanzaki Paper Manufacturing Company, Limited, Tokyo, Japan

[21] Appl. No.: 790,992

[22] Filed: Oct. 24, 1985

[30] Foreign Application Priority Data

Oct. 25, 1984 [JP] Japan ..... 59-224457

[51] Int. Cl.[4] ..... B41M 5/18

[52] U.S. Cl. ..... 346/200; 346/226; 427/152

[58] Field of Search ..... 346/200, 214, 226; 427/150, 151, 152

[56] References Cited

U.S. PATENT DOCUMENTS 4,370,370 1/1983 Iwata et al. ..... 428/40

4,420,538 12/1983 Nakamura et al. ..... 427/151

*Primary Examiner*—Bruce H. Hess

*Attorney, Agent, or Firm*—Armstrong, Nikaido, Marmelstein & Kubovcik

[57] ABSTRACT

This invention provides a heat-sensitive recording material comprising a base sheet and a heat-sensitive record layer formed over the base sheet and containing a color forming material and a color developing material which undergoes a color forming reaction on contact with the color forming material, the heat-sensitive recording material being characterized in that a resin layer containing a cationic-modified starch is formed over the heat-sensitive record layer.

The resin-coated heat-sensitive recording material of the invention is free of sticking, and resistant to diazo developer and suppresses the powder-coated phenomenon due to the bleeding of crystallized color forming material, color developing material and the like.

8 Claims, No Drawings

HEAT-SENSITIVE RECORDING MATERIAL

This invention relates to heat-sensitive recording materials, and more particularly to heat-sensitive recording materials having outstanding image density retentivity.

Heat-sensitive recording materials are well known which make use of the color forming reaction of a color forming material with a color developing material which develops a color on contact with the color forming material, such that the two materials are brought into contact with each other by heating to produce a color image. These heat-sensitive recording materials are relatively inexpensive, and recording devices therefor are compact and relatively easy to maintain. Accordingly such recording materials are useful as recording media for facsimile systems, computers, etc. and are also in wide use for other applications.

However, the heat-sensitive recording material is generally low in resistance to water, oils, usual organic solvents and plasticizers and therefore has the drawback that when the color image formed is brought into contact with water, oil, usual organic solvents or plasticizer contained in plastic film, the image density markedly reduces. During the handling, the recording material produces images resembling fingerprints merely when touched with the fingers, or causes the undesired development of color even when slightly scratched. Furthermore, the heat-sensitive layer of the recording material may become powder-coated due to the bleeding of crystallized color forming material, color developing material and the like, and give powdery appearance at the portion where a record image has been formed (hereinafter referred to as "powder-coated phenomenon").

On the other hand, these heat-sensitive recording materials are being used in various manners with the rapidly increasing use of thermal facsimiles, thermal printers and the like, and thus are more frequently stored as laid over other recording media such as diazo copying paper (diazo type paper). However, when a heat-sensitive recording material is stored in contact with diazo copying paper, particularly such paper subjected to copying operation immediately before contact, the record image formed is markedly prone to fade or disappear and the white background portion of the recording material significantly tends to undergo the coloring (fogging) due to the action of the diazo developer remaining on the diazo copying paper and lose its whiteness. At present, it is strongly desired to remedy the foregoing serious drawbacks of the heat-sensitive recording materials.

Various methods have been proposed to overcome these drawbacks. For example, it has been proposed to coat a heat-sensitive record layer with an aqueous emulsion of a resin having ability to form a film and resistance to chemicals (Unexamined Japanese Patent Publication No. 128347/1979), or with a water-soluble polymeric material such as polyvinyl alcohol or the like (U.S. Pat. No. 4,370,370).

The proposed methods, however, have failed to achieve satisfactory results and even entail further defects. For example, heat-sensitive recording material having such a resin layer formed thereon tends to pose the problem that the resin layer sticks to a thermal head during recording (hereinafter referred to as "sticking").

It is an object of this invention to provide heat-sensitive recording materials free from the foregoing drawbacks of conventional heat-sensitive recording materials.

It is another object of the invention to provide heat-sensitive recording materials which do not readily cause sticking.

It is a further object of the invention to provide heat-sensitive recording materials which, even when contacted with a diazo developer, do not allow the fading of record images or cause fogging of the background portion.

It is a still further object of the invention to provide heat-sensitive recording materials which do not entail the powder-coated phenomenon which otherwise would take place due to the crystallization of the color forming material, color developing material and the like.

These objects and other features of this invention will become apparent from the following description.

This invention provides a heat-sensitive recording material comprising a base sheet and a heat-sensitive record layer formed over the base sheet and containing a color forming material and a color developing material which undergoes a color forming reaction on contact with the color forming material, the heat-sensitive recording material being characterized in that a resin layer containing a cationic-modified starch is formed over the heat-sensitive record layer.

We conducted extensive research on protective resin layers formed on heat-sensitive record layers among others to develop heat-sensitive recording materials which will not involve the reduction of image density retentivity even when contacted with a diazo developer as well as with water, oils, usual organic solvents, plasticizers and the like. In the course of research, we found that although the conventional resin layers can achieve improvements to some extent on the resistance to water, oils, usual organic solvents and plasticizers, the layers entail difficulties in enhancing the resistance to diazo developers. We also found that the fading of record images and fogging of background portions are caused by the interaction between the color developing material, color forming material or the like and the specific solvent component present in the developer of the diazo copying paper, particularly a mixture of ethylene glycol and its oligomers (e.g., diethylene glycol, triethylene glycol, etc.). We carried out investigations on a protective resin layer which prevents the action of the solvent component of the diazo developer, and which does not cause sticking. Consequently, our investigations have revealed that the heat-sensitive recording material prepared by using a cationic-modified starch (also termed "cationic starch", hereinafter referred to as "cationic-modified starch") as a resin for forming a protective resin layer has a high resistance to diazo developers as well as to water, oils, usual organic solvents and plasticizers. It has also been found that the heat-sensitive recording material thus prepared is free from sticking and also suppresses the bleeding of crystallized components and does not pose the problem of powder-coated phenomenon. This invention has been accomplished based on these novel findings.

The heat-sensitive recording materials of this invention are outstanding in resistance to diazo developers and are unlikely to undergo the powder-coated phenomenon. Further the recording materials of this invention are free from the problem of sticking, unlike the conventional heat-sensitive recording materials with a resin layer formed thereon. Additionally the recording materials of the invention are also high in resistance to water, oils, usual organic solvents and plasticizers, and will not produce color images like fingerprints when touched by the fingers nor cause the undesired development of color when scratched.

According to the invention, any of known sheets are usable as base sheets. Typical of such sheets are paper, paper of synthetic fiber, synthetic resin film, etc., among which paper is most preferred in terms of costs, coating properties, etc.

The combinations of color forming materials and color developing materials to be incorporated in the record layer according to this invention are not specifically limited, and can be any of those which can cause a color forming reaction upon contact of the two materials. Useful examples are the combination of a colorless or pale-colored basic dye and an inorganic or organic acidic material, and the combination of ferric stearate or like metallic salt of higher fatty acid and gallic acid or like phenol. Further usable in this invention are the combinations of a diazonium compound, a coupler and a basic substance which can form a color by application of heat. The heat-sensitive recording materials of this invention include those comprising various combinations of these materials.

The resin layer of this invention formed on the record layer of a heat-sensitive recording material, when formed especially on the heat-sensitive record layer containing a basic dye and an acidic material, can afford a remarkably improved image density retentivity to the heat-sensitive recording material. Thus the resin layer of this invention is most preferably used when the heat-sensitive record layer contains these substances.

Examples of useful colorless or pale-colored basic dyes are those already known and include:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-diethylamino-7-(o-fluorophenylamino)fluoran, 3-dibutylamino-7-(o-fluorophenylamino)fluoran, 3-(N-ethyl-N-cyclopentylamino)-6-methyl-7-anilinofluoran, 3-(N-methyl-N-cyclopentylamino)-6-methyl-7-p-toluidinofluoran, 3-(N-butyl-N-cyclopentylamino)-6-methyl-7-anilinofluoran, 3-(N-methyl-N-tetrahydrofurfurylamino)-6-methyl-7-anilinofluoran, 3-(N-ethyl-N-tetrahydrofurfurylamino)-6-methyl-7-anilinofluoran, 3-pyrrolidino-6-methyl-7-p-butylphenylaminofluoran, etc.

Examples of inorganic or organic acidic materials which undergo a color forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-phenoxyphenol $\alpha$-naphthol, $\beta$-naphthol, 4-hydroxy-acetophenone, 4-tert-octylcatechol, 2,2'-dihydroxydiphenyl, 4,4'-iso-propylidenebis(2-tert-butylphenol), 4,4'-sec-butylidenediphenol, 4-phenylphenol, 4,4'-isopropylidenediphenol(bis-phenol A), 2,2'-methylenebis(4-chlorophenol), hydroquinone, 4,4'-cyclohexylidenediphenol, 4-hydroxybenzoic acid benzyl ester, 4-hydroxyphthalic acid dimethyl ester, hydroquinone monobenzyl ether, 4-hydroxy-4'-methyldiphenylsulfone, 4-hydroxy-4'-chlorodiphenylsulfone, 4-hydroxy-4'-methoxydiphenylsulfone, 4-hydroxy-4'-ethoxydiphenylsulfone, novolak phenol resins and phenolic polymers; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-($\alpha$-methylbenzyl)-salicylic acid, 3-chloro-5-($\alpha$-methylbenzyl)-salicylic acid, 3,5-di-tert-butylsalicylic acid, 3-phenyl-5-($\alpha$,$\alpha$-dimethylbenzyl)salicylic acid and 3,5-di-($\alpha$-methylbenzyl)-salicylic acid; also, salts of such phenolic compounds or aromatic carboxylic acids with polyvalent metals such as zinc, magnesium, aluminum, calcium, titanium, manganese, tin and nickel.

For the preparation of the heat-sensitive recording material of the present invention, the proportions of the color forming material and the color developing material to be incorporated into the record layer are suitably determined according to the kinds of these materials and are not particularly limited. For example, when the combination of a colorless or pale-colored basic dye and an inorganic or organic acidic material is used, about 1 to about 50 parts by weight, preferably about 1 to about 10 parts by weight, of the acidic material is used per part by weight of the basic dye.

These materials are formulated into a heat-sensitive coating composition generally with use of water as a dispersion medium and a stirring or pulverizing device, such as a ball mill, attritor or sand mill, by dispersing the two materials at the same time or separately. Usually the coating composition has incorporated therein a binder, such as starch, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer salt, styrene-butadiene copolymer emulsion or the like. The binder is used in an amount of about 10 to about 70% by weight, preferably about 15 to about 50% by weight, based on the total solids content of the composition.

Various auxiliary agents can be further admixed with the heat-sensitive coating composition. Examples of useful auxiliary agents are dispersants such as sodium diocytylsulfosuccinate, sodium dodecylbenzenesulfonate, sodium lauryl sulfate, alginate and fatty acid metallic salts; ultraviolet absorbers of the benzophenone, triazole or like type; defoaming agents, fluorescent dyes; coloring dyes, etc.

Further when desired, other additives can be incorporated into the composition. Examples of useful additives are waxes such as zinc stearate, calcium stearate, polyethylene wax, carnauba wax, paraffin wax and ester wax, and inorganic pigments such as kaolin, clay, talc, calcium carbonate, calcined clay, titanium oxide, diatomaceous earth, fine granular anhydrous silica and activated clay. As the sensitizer, heat-fusible materials can be incorporated into the composition. Examples of useful heat-fusible materials are fatty acid amides such as stearic acid amide, stearic acid methylenebisamide, oleic acid amide, palmitic acid amide, sperm oleic acid amide and coconut fatty acid amide, hindered phenols such as 2,2'-methylenebis(4-methyl-6-tert-butylphenol), 4,4'-butylidenebis(6-tert-butyl-3-methylphenol), 1,1,3-tris(2-methyl-4-hydroxy-5-tert-butylphenyl)butane and the like, dibenzyl terephthalate, 1,2-diphenoxyethane, 1,2-di(3-methyl-phenoxy)ethane, 1-(4-chlorophenoxy)-2-phenoxyethane, 1-(4-methoxyphenoxy)-2-phenoxyethane, 4,4'-ethylenedioxy-bis-benzoic acid diphenylmethyl ester and the like.

The method of forming the record layer of the heat-sensitive recording material of the invention is not particularly limited but can be any of conventional methods. For example, the heat-sensitive coating composition is applied to the base sheet by air knife coating or blade coating and then dried. The amount of the coating composition, which is also not particularly limited, is generally about 2 to about 12 g/m$^2$, preferably about 3 to about 10 g/m$^2$, based on dry weight.

As stated above, it is essential in the invention to form a resin layer containing a cationic-modified starch as the main component on the heat-sensitive record layer thus formed. Examples of such cationic-modified starches are a wide variety of those prepared by modifying starch with a primary, secondary or tertiary amine or a quaternary ammonium salt, and capable of forming a uniform and smooth layer when applied in the form of an aqueous solution to the heat-sensitive record layer and dried.

Typical examples of cationic-modified starches are those prepared by modifying starch with a cationic modifier such as ethylene imine or a halogenated alkylamine of the formula

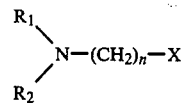

(I)

wherein $R_1$ and $R_2$ are each hydrogen atom or alkyl having 1 to 5 carbon atoms, X is halogen atom such as chlorine and bromine, and n is an integer of 1 to 3, or an epoxyalkyltrialkylammonium salt of the formula

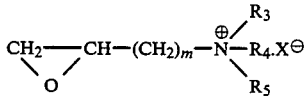

(II)

wherein $R_3$, $R_4$ and $R_5$ are each alkyl having 1 to 5 carbon atoms or benzyl, X is halogen such as chlorine and bromine and m is an integer of 1 or 2, or those disclosed by Fanta et al., in Journal of Applied Polymer Science, 15, 1889 (1971). Useful cationic-modified starches are not particularly limited to those exemplified above, and other cationic-modified starches are also usable so far as they have the foregoing property.

Generally, the cationic-modified starches are prepared by dispersing starch particles in an aqueous solution containing a strong base such as sodium hydroxide and an appropriate cationic modifier such as ethylene imine or one having the formulas (I) and (II) and the like, and reacting the mixture at about 40° to about 50° C. for several hours.

Of the above-mentioned cationic modifiers, exemplary of the halogenated alkylamines of the formula (I) are aminomethyl chloride, dimethylaminomethyl chloride, diethylaminomethyl chloride, dipropylaminomethyl chloride, dibutylaminomethyl chloride, dipentylaminomethyl chloride, 2-aminoethyl chloride, 2-dimethylaminoethyl chloride, 2-diethylaminoethyl chloride, 2-diethylaminoethyl bromide, 2-dipropylaminoethyl chloride, 2-dibutylaminoethyl chloride, 2-dipentylaminoethyl chloride, 3-aminopropyl chloride, 3-dimethylaminopropyl chloride, 3-diethylaminopropyl chloride, 3-dipropylaminopropyl chloride, 3-dibutylaminopropyl chloride, etc. Representative of the epoxyalkyltrialkylammonium salts of the formula (II) are 2,3-epoxypropyltrimethylammonium chloride, 2,3-epoxypropyltriethylammonium chloride, 2,3-epoxypropyltripropylammonium chloride, 2,3-epoxypropyltributylammonium chloride, 2,3-epoxypropyltripentylammonium chloride, 3,4-epoxybutyltrimethylammonium chloride, 3,4-epoxybutyltriethylammonium chloride, 3,4-epoxybutyltripropylammonium chloride, 3,4-epoxybutyltributylammonium chloride, 3,4-epoxybutyltripentylammonium chloride, 2,3-epoxypropyl-N,N-dimethyl-N-benzylammonium chloride, 2,3-epoxypropyl-N,N-diethyl-N-benzylammonium chloride, 2,3-epoxypropyl-N,N-dipropyl-N-benzylammonium chloride, 3,4-epoxybutyl-N,N-dimethyl-N-benzylammonium chloride, 3,4-epoxybutyl-N,N-diethyl-N-benzylammonium chloride, etc.

Of these cationic-modified starches, preferred starches are those prepared using as a cationic-modifier a halogenated alkylamine represented by the formula

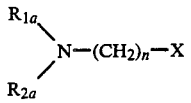

(Ia)

wherein $R_{1a}$ and $R_{2a}$ are each alkyl having 1 to 5 carbon atoms, X is halogen atom and n is an integer of 1 to 3, or a quaternary ammonium salt represented by the formula

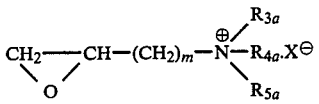

(IIa)

wherein $R_{3a}$, $R_{4a}$ and $R_{5a}$ are each alkyl having 1 to 5 carbon atoms, X is halogen atom and m is 1 or 2, because these starches are easily available.

It is desired that these cationic-modified starches have a degree of substitution ranging from about 0.005 to about 0.10, preferably from about 0.01 to about 0.05. Below about 0.005 in degree of substitution, the coating composition tends to gel and become too viscous to apply, whereas above 0.10, the heat-sensitive recording material will have reduced image density retentivity and often fail to achieve the desired results of this invention.

The term "degree of substitution" used herein refers to the number of substituted hydroxyl groups per glucose unit. For example, when three hydroxyl groups in each of all glucose units present in the starch are all substituted, the degree of substitution is 3. When one hydroxyl group in one of 100 glucose units is substituted, the degree of substitution is 0.01.

The foregoing cationic-modified starches are formulated into an aqueous solution to give a coating composition for forming the resin layer (hereinafter referred to as "resin layer coating composition"), and the resin layer coating composition is applied to a heat-sensitive record layer by a conventional coating device. The concentration of the cationic-modified starch solution is not critical, but is preferably about 2 to about 20% by weight from the viewpoint of ease of coating operation.

While the aforesaid cationic-modified starches, when singly used, can impart improved retentivity of image density and excellent ability to prevent sticking, the cationic-modified starch, if desired, can be used in combination with a water-soluble resin having a high curability such as acetoacetylated polyvinyl alcohol and other modified polyvinyl alcohol, oxidized starch, methyl cellulose, hydroxypropylmethyl cellulose, etc. Such water-soluble resin is used preferably in an amount of about 10% by weight or less based on the combined weight of the cationic-modified starch and the resin. The cationic-modified starch or the combination of the cationic-modified starch and the water-soluble resin used when required will hereinafter be referred to as "resin component".

When a cross-linking agent is incorporated into the foregoing resin component, preferred results can be obtained. Examples of useful cross-linking agents are those which can cross-link the hydrophilic groups of the resin component at a temperature at which the heat-sensitive record layer does not undergo development of color. Such cross-linking agents include aldehydes such as formaldehyde, glyoxal, dialdehyde starch and polyacrolein, methylol compounds such as N-methylolurea, N-methylolmelamine and N-methylolethyleneurea, epoxy compounds such as epichlorohydrin, dicarboxylic acids such as succinic acid and esters thereof, boric acid, borax, titanium oxysulfate, α-titanic acid, zirconium ammonium carbonate, alkoxides of Ti, Zr and Al, etc.

A suitable cross-linking agent is selected so as to meet the quality requirement and the like. Two or more kinds of the agents can be used in mixture. The amount of the cross-linking agent is adequately determined according to the desired quality of the heat-sensitive recording material, composition of the resin component, kind of cross-linking agent used, viscosity of the resin layer coating composition, etc. Preferred amount is about 0.1 to about 100 parts by weight per 100 parts by weight of the resin component.

When required, a pigment can be incorporated into the resin layer coating composition predominantly containing the specific cationic-modified starch according to this invention to improve the printability of the resulting resin layer and/or to more effectively prevent sticking. Examples of suitable pigments are inorganic pigments such as calcium carbonate, zinc oxide, aluminum oxide, titanium dioxide, silicon dioxide, aluminum hydroxide, barium sulfate, zinc sulfate, talc, kaolin, clay, calcined clay and colloidal silica, organic pigments such as styrene microballs, nylon powder, polyethylene powder, urea-formaldehyde resin filler and raw starch particles, etc. The pigment useful in this invention are those having a particle size of about 10 μm or less, preferably about 5 μm or less, more preferably about 2 μm or less. The amount of the pigment is preferably about 5 to about 500 parts by weight per 100 parts by weight of the resin component.

The resin layer coating composition can be further mixed, when required, with a lubricant such as zinc stearate, calcium stearate, stearic acid amide, polyethylene wax, carnauba wax, paraffin wax and ester wax; surfactant (as a dispersant or moisturizing agent) such as sodium dioctylsulfosuccinate, sodium dodecylbenzenesulfonate, sodium lauryl sulfate, alginates and fatty acid metal salts; ultraviolet absorbers of the benzophenone, triazole or like type; defoaming agent; fluorescent dye; coloring dye; etc.

When required, the aqueous coating composition is subjected to mixing or dispersing operation with use of a mixing or agitating device such as a mixer, attritor, ball mill or roll mill.

The resin layer coating composition predominantly containing a cationic-modified starch thus prepared is applied in an amount not specifically limitative. Below about 0.1 g/m$^2$ based on dry weight, the desired effects of this invention will not be achieved to a satisfactory extent, whereas above about 20 g/m$^2$ based on dry weight, the heat-sensitive recording material of this invention tends to exhibit a reduced record sensitivity. Accordingly the amount of the coating composition is about 0.1 to about 20 g/m$^2$, preferably about 0.5 to about 10 g/m$^2$ based on dry weight.

The resin layer coating composition applied to the heat-sensitive record layer of a heat-sensitive recording material is dried at a temperature at which the record layer does not undergo development of color. When the cross linking agent is used, a cross-linking reaction proceeds at the drying temperature.

When required, such resin layer can be formed on the rear side of the heat-sensitive recording material to enhance the image density retentivity. Other means known in the art can also be adopted. For example, an undercoat may be formed on the base sheet. An adhesive layer may be formed on the rear side of a heat-sensitive recording material so that the resulting recording material can be used as an adhesive label.

The present invention will be described below in greater detail with reference to the following examples, to which the invention of course is in no way limited. In these examples, the parts and the percentages are all by weight unless otherwise specified.

EXAMPLE 1

(1) Preparation of mixture A 3-(N-Cyclohexyl-N-methylamino)-6-methyl-7-phenylaminofluoran: 10 parts Dibenzyl terephthalate (sensitizer): 20 parts 5% Aqueous solution of methyl cellulose: 5 parts Water: 80 parts The above mixture was pulverized by a sand mill to a mean particle size of 3 μm.

(2) Preparation of mixture B 4,4'-Isopropylidenediphenol: 20 parts

5% Aqueous solution of methyl cellulose: 5 parts

Water: 55 parts

The above mixture was pulverized by a sand mill to a mean particle size of 3 μm.

(3) Formation of record layer

A 115 parts portion of the mixture A, 80 parts of the mixture B, 50 parts of 20% aqueous solution of oxidized starch and 10 parts of water were mixed together and agitated to obtain a heat-sensitive coating composition. The composition was applied to non-coated paper weighing 50 g/m$^2$ in an amount of 5 g/m$^2$ based on dry weight and then dried to obtain a heat-sensitive recording paper.

A resin layer coating composition given below was applied onto the record layer of the paper in an amount of 3 g/m$^2$ based on dry weight to obtain a resin-coated heat-sensitive recording paper.

| Resin layer coating composition | |
|---|---|
| 15% Aqueous solution of cationic-modified starch (starch modified with 2,3-epoxy-propyltrimethylammonium chloride, degree of substitution 0.01 to 0.03, "AMYLOFAX 15", product of AVEBE, Netherlands) | 667 parts |
| Kaolin ("UW-90", product of Engelhard Minerals & Chemicals Corp., mean particle size 0.5 μm) | 200 parts |
| Water | 1133 parts |

EXAMPLE 2

A resin-coated heat-sensitive recording paper was prepared in the same manner as in Example 1 except that the following resin layer coating composition was used.

| | |
|---|---|
| 10% Aqueous solution of cationic-modified starch (starch modified with 2,3-epoxy-propyltrimethylammonium chloride, degree of substitution 0.005 to 0.015, "AMYLOFAX 10", product of AVEBE) | 1000 parts |
| Kaolin ("UW-90") | 200 parts |
| Water | 800 parts |

EXAMPLE 3

A resin-coated heat-sensitive recording paper was prepared in the safe manner as in Example 1 except that the following resin layer coating composition was used.

| | |
|---|---|
| 15% Aqueous solution of cationic-modified starch (starch modified with 2,3-epoxy-propyltrimethylammonium chloride, degree of substitution 0.01 to 0.03, "AMYLOFAX 15", product of AVEBE) | 667 parts |
| Kaolin ("UW-90") | 200 parts |
| 40% Aqueous solution of glyoxal | 50 parts |
| Water | 2133 parts |

EXAMPLE 4

A resin-coated heat-sensitive recording paper was prepared in the safe manner as in Example 1 except that the following resin layer coating composition was used.

| | |
|---|---|
| 7% Aqueous solution of cationic-modified starch (starch modified with 2-diethyl-aminoethyl chloride, degree of substitution 0.03 to 0.06) | 1430 parts |
| Kaolin ("UW-90") | 200 parts |
| Water | 370 parts |

EXAMPLE 5

A resin-coated heat-sensitive recording paper was prepared in the same manner as in Example 1 except that the following resin layer coating composition was used.

| | |
|---|---|
| 7% Aqueous solution of cationic-modified starch (starch modified with 2-diethyl-aminoethyl chloride, degree of substitution 0.02 to 0.05) | 1430 parts |
| Aluminum hydroxide ("HIGILITE H-42", product of Showa Keikinzoku Kabushiki Kaisha, Japan, mean particle size 1.5 μm) | 200 parts |
| Water | 370 parts |

EXAMPLES 6 and 7

Two kinds of resin-coated heat-sensitive recording papers were prepared in the same manner as in Example 4 except that the following cationic-modified starch was used.

| Example | Cationic-modified starch |
|---|---|
| 6 | Starch modified with 2-dimethylaminoethyl chloride (degree of substitution 0.01–0.025) |
| 7 | Starch modified with 2,3-epoxypropyltriethyl-ammonium chloride (degree of substitution 0.03–0.05) |

COMPARISON EXAMPLES 1 and 2

Two kinds of resin-coated heat-sensitive recording papers were prepared in the same manner as in Example 1 with the exception of using an oxidized starch ("Ace B," product of Oji Cornstarch Co., Ltd.) in Comparison Example 1 and polyvinyl alcohol ("PVA 117," product of Kuraray Co., Ltd.) in Comparison Example 2.

EXAMPLE 8

(1) Preparation of mixture A
3-(N-Cyclohexyl-N-methylamino)-6-methyl-7-phenylaminofluoran: 10 parts
Dibenzyl terephthalate: 20 parts
5% Aqueous solution of methyl cellulose: 5 parts
Water: 80 parts The above mixture was pulverized by a sand mill to a mean particle size of 3 μm.

(2) Preparation of mixture B
4,4'-Isopropylidenediphenol: 20 parts
5% Aqueous solution of methyl cellulose: 5 parts
Water: 55 parts The above mixture was pulverized by a sand mill to a mean particle size of 3 μm.

(3) Formation of record layer

A 115 parts portion of the mixture A, 80 parts of the mixture B, 50 parts of 20% aqueous solution of oxidized starch and 10 parts of water were mixed together and agitated to obtain a heat-sensitive coating composition. The composition was applied to non-coated paper weighing 50 g/m$^2$ in an amount of 5 g/m$^2$ based on dry weight and then dried to obtain a heat-sensitive recording paper.

A resin layer coating composition given below was applied onto the record layer of the paper in an amount of 3 g/m$^2$ based on dry weight to obtain a resin-coated heat-sensitive recording paper.

Resin layer coating composition

15% Aqueous solution of cationic-modified starch (starch modified with 2,3-epoxypropyltrimethylammonium chloride, degree of substitution 0.01 to 0.03, "AMYLOFAX 15", product of AVEBE).

EXAMPLE 9

A resin-coated heat-sensitive recording paper was prepared in the same manner as in Example 8 except that the following resin layer coating composition was used.

10% Aqueous solution of cationic-modified starch (starch modified with 2,3-epoxypropyltrimethylammonium chloride, degree of substitution 0.005 to 0.015, "AMYLOFAX 10", product of AVEBE).

EXAMPLE 10

A resin-coated heat-sensitive recording paper was prepared in the same manner as in Example 8 except that the following resin layer coating composition was used.

7% Aqueous solution of cationic-modified starch (starch modified with 2-diethylaminoethyl chloride, degree of substitution 0.03 to 0.06).

COMPARISON EXAMPLES 3 and 4

Two kinds of resin-coated heat-sensitive recording papers were prepared in the same manner as in Example 8 with the exception of using an oxidized starch ("Ace B," product of Oji Cornstarch Co., Ltd.) in Comparison Example 3 and polyvinyl alcohol ("PVA 117," product of Kuraray Co., Ltd.) in Comparison Example 4.

EXAMPLE 11

(1) Preparation of mixture A
3-(N-Cyclohexyl-N-methylamino)-6-methyl-7-phenylaminofluoran: 10 parts
5% Aqueous solution of methyl cellulose: 5 parts
Water: 30 parts The above mixture was pulverized by a sand mill to a mean particle size of 3 μm.

(2) Preparation of mixture B
4,4'-Isopropylidenediphenol: 20 parts
5% Aqueous solution of methyl cellulose: 5 parts
Water: 55 parts The above mixture was pulverized by a sand mill to a mean particle size of 3 μm.

(3) Formation of record layer

Forty-five parts of the mixture A, 80 parts of the mixture B, 50 parts of 20% aqueous solution of oxidized starch and 10 parts of water were mixed together and agitated to obtain a heat-sensitive coating composition. The composition was applied to non-coated paper weighing 50 g/m$^2$ in an amount of 5 g/m$^2$ based on dry weight and then dried to obtain a heat-sensitive recording paper.

A resin layer coating composition given below was applied onto the record layer of the paper in an amount of 3 g/m$^2$ based on dry weight to obtain a resin-coated heat-sensitive recording paper.

Resin layer coating composition

15% Aqueous solution of cationic-modified starch (starch modified with 2,3-epoxypropyltrimethylammonium chloride, degree of substitution 0.01 to 0.03, "AMYLOFAX 15", product of AVEBE).

EXAMPLE 12

A resin-coated heat-sensitive recording paper was prepared in the same manner as in Example 11 except that the following resin layer coating composition was used.

10% Aqueous solution of cationic-modified starch (starch modified with 2,3-epoxypropyltrimethylammonium chloride, degree of substitution 0.005 to 0.015, "AMYLOFAX 10", product of AVEBE).

COMPARISON EXAMPLES 5 and 6

Two kinds of resin-coated heat-sensitive recording papers were prepared in the same manner as in Example 11 with the exception of using an oxidized starch ("Ace B," product of Oji Cornstarch Co., Ltd.) in Comparison Example 5 and polyvinyl alcohol ("PVA 117," product of Kuraray Co., Ltd.) in Comparison Example 6.

The 18 kinds of resin-coated heat-sensitive recording papers were tested as follows.

(1) Sticking

The 18 kinds of resin-coated heat-sensitive recording papers were caused to form colored images thereon with use of a thermal facsimile (product of Toshiba Corporation, Model KB-500) and the degree of sticking was evaluated with the results shown below in Table 1.

(2) Initial image density and initial whiteness

The recording papers were pressed to a thermal plate at 120° C. under a pressure of 2 kg/cm$^2$ for 10 seconds to develop color thereon, and the initial image density and the initial whiteness (color density of non-image area) were measured by a Macbeth densitometer (product of Macbeth Corp., Model RD-100R, using an amber filter). Table 1 also shows the results.

(3) Resistance to diazo developer (diazo test)

Each of the resin-coated heat-sensitive recording papers with the colored images formed by the thermal plate in the same manner as in (2) above was superposed on diazo copying paper which had been developed with a diazo developer (product of Ricoh Company, Ltd., Ricopy Diazo Developer SD) to bring the diazo copying paper into contact with the resin-coated layer. The diazo copying paper and the resin-coated heat-sensitive recording paper were left to stand under a pressure of 2 g/cm$^2$ for 5 minutes, and thereafter the image density and the whiteness of the background portion of the resin-coated heat-sensitive recording paper were measured in the same manner as in (2) above. Table 1 shows the results.

(4) Powder-coated phenomenon

The resin-coated heat-sensitive recording papers with the colored images produced by the thermal plate in the same manner as in (2) above were allowed to stand at 40° C. for a week, and thereafter checked with an unaided eye for the presence of the powder-coated phenomenon in the image portion due to the bleeding of the crystallized color developing material, color forming material and the like. Table 1 shows the results.

TABLE 1

| | Sticking | Initial image density | Initial whiteness | Image density-after diazo test | Whiteness after diazo test | Powder-coated phenomenon |
|---|---|---|---|---|---|---|
| Ex. 1 | A | 1.32 | 0.06 | 1.28 | 0.07 | A |
| 2 | A | 1.29 | 0.06 | 1.26 | 0.06 | A |
| 3 | A | 1.30 | 0.06 | 1.27 | 0.07 | A |
| 4 | A | 1.30 | 0.06 | 1.20 | 0.09 | B |
| 5 | A | 1.31 | 0.06 | 1.20 | 0.09 | B |
| 6 | A | 1.29 | 0.06 | 1.19 | 0.09 | B |
| 7 | A | 1.30 | 0.06 | 1.26 | 0.07 | A |
| Comp. Ex. 1 | C | 1.30 | 0.07 | 1.15 | 0.13 | C |
| 2 | D | 1.31 | 0.07 | 1.24 | 0.11 | D |
| Ex. 8 | B | 1.35 | 0.06 | 1.32 | 0.06 | A |
| 9 | B | 1.34 | 0.06 | 1.31 | 0.06 | A |
| 10 | B | 1.32 | 0.06 | 1.22 | 0.07 | B |
| Comp. Ex. 3 | C | 1.33 | 0.07 | 1.18 | 0.10 | C |
| 4 | D | 1.35 | 0.06 | 1.28 | 0.09 | D |
| Ex. 11 | B | 1.02 | 0.06 | 0.97 | 0.06 | A |
| 12 | B | 1.03 | 0.06 | 0.96 | 0.06 | A |
| Comp. Ex. 5 | C | 1.01 | 0.07 | 0.86 | 0.10 | C |
| 6 | D | 1.02 | 0.06 | 0.90 | 0.10 | D |

Criteria of evaluation (1) Sticking
- A. None
- B. Little found
- C. Slightly found (negligible in letter-recording but practically defective in picture-recording)
- D. Markedly found (seriously defective)

(2) Powder-coated phenomenon
- A. None
- B. Slightly found (posing no problem)
- C. Noticeably found (defective)
- D. Markedly found (seriously defective)

As seen from Table 1, the heat-sensitive recording papers of the invention do not pose the problem of sticking and powder-coated phenomenon, and retain high whiteness and image density even after the diazo test, indicating that they are resistant to diazo developer.

We claim:

1. A heat-sensitive recording material comprising a base sheet and a heat-sensitive record layer formed over the base sheet and containing a color forming material and a color developing material which undergoes a color forming reaction on contact with the color forming material, the heat-sensitive recording material being characterized in that a resin layer containing a cationic-modified starch is formed over the heat-sensitive record layer.

2. A heat-sensitive recording material as defined in claim 1 wherein the cationic-modified starch is one which is prepared by modifying starch with a primary, secondary or tertiary amine, or quaternary ammonium, and which is capable of producing a uniform and smooth layer when applied to the heat-sensitive record layer in the form of an aqueous solution and dried.

3. A heat-sensitive recording material as defined in claim 1 wherein the cationic-modified starch is one prepared by modifying starch with ethylene imine, halogenated alkylamine represented by the formula

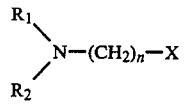

(I)

wherein $R_1$ and $R_2$ are each hydrogen atom or alkyl having 1 to 5 carbon atoms, X is halogen atom and n is an integer of 1 to 3, or epoxyalkyltrialkyl ammonium salt represented by the formula

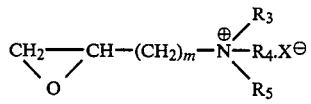

(II)

wherein $R_3$, $R_4$ and $R_5$ are each alkyl having 1 to 5 carbon atoms or benzyl, X is halogen atom, and m is an integer of 1 or 2.

4. A heat-sensitive recording material as defined in claim 1 wherein the cationic-modified starch has a degree of substitution of about 0.005 to about 0.10.

5. A heat-sensitive recording material as defined in claim 1 wherein the cationic-modified starch is one prepared by modifying starch with halogenated alkylamine represented by the formula

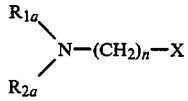

(Ia)

wherein $R_{1a}$ and $R_{2a}$ are each alkyl having 1 to 5 carbon atoms, X is halogen atom, and n is an integer of 1 to 3.

6. A heat-sensitive recording material as defined in claim 1 wherein the cationic-modified starch is one prepared by modifying starch with epoxyalkyltrialkylammonium salt represented by the formula

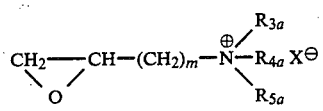

(IIa)

wherein $R_{3a}$, $R_{4a}$ and $R_{5a}$ are each alkyl having 1 to 5 carbon atoms, X is halogen atom, and m is an integer of 1 or 2.

7. A heat-sensitive recording material as defined in claim 1 wherein the resin layer further contains a pigment.

8. A heat-sensitive recording material as defined in claim 1 wherein the resin layer further contains a cross linking agent.

* * * * *